US012546181B2

(12) United States Patent
Aviles et al.

(10) Patent No.: US 12,546,181 B2
(45) Date of Patent: Feb. 10, 2026

(54) SMART PLUG INTEGRATED SENSOR SYSTEM

(71) Applicant: Schlumberger Technology Corporation, Sugar Land, TX (US)

(72) Inventors: Isaac Aviles, Sugar Land, TX (US); John Whitsitt, Houston, TX (US); William Norrid, Denver, CO (US); Sidney Jasek, Hallettsville, TX (US); Robert M. Graham, Houston, TX (US); Laurent Alteirac, Missouri City, TX (US); Bhushan Pendse, Houston, TX (US); Audrey Cherel, Houston, TX (US); Huilin Tu, Sugar Land, TX (US); Houssem Kharrat, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/443,499

(22) Filed: Feb. 16, 2024

(65) Prior Publication Data

US 2024/0183244 A1 Jun. 6, 2024

Related U.S. Application Data

(62) Division of application No. 17/415,406, filed as application No. PCT/US2019/067046 on Dec. 18, 2019, now abandoned.

(Continued)

(51) Int. Cl.

| | |
|---|---|
| ***E21B 33/12*** | (2006.01) |
| ***E21B 47/01*** | (2012.01) |

(Continued)

(52) U.S. Cl.

CPC ..... *E21B 33/12* (2013.01); *E21B 47/01* (2013.01); *E21B 47/06* (2013.01); *E21B 47/13* (2020.05); *E21B 43/26* (2013.01)

(58) Field of Classification Search

CPC ..... E21B 33/10; E21B 33/12; E21B 33/1204; E21B 47/01; E21B 47/06; E21B 23/06

See application file for complete search history.

(56) References Cited

U.S. PATENT DOCUMENTS

| | | | |
|---|---|---|---|
| 900,440 | A | 10/1908 | Spang |
| 1,476,727 | A | 12/1923 | Quigg |

(Continued)

FOREIGN PATENT DOCUMENTS

| | | | |
|---|---|---|---|
| CN | 103097656 | A | 5/2013 |
| CN | 103261582 | A | 8/2013 |

(Continued)

*Primary Examiner* — Kenneth L Thompson

(74) *Attorney, Agent, or Firm* — Jeffrey D. Frantz

(57) ABSTRACT

A technique facilitates collecting data, related to a fracturing, run-in-hole, or pull-out-of hole operation. A frac plug is provided with electronics for obtaining the desired information related to the operation. For example, the frac plug may be constructed with electronic sensors, a digital storage device, and a power supply or other power related equipment. Depending on the application, the frac plug may be a composite frac plug, degradable frac plug, dummy frac plug, or other suitable frac plug. Retrieval of the information obtained may be done via coupling with an associated device, e.g. inductive or physical coupling, by utilizing a broadcast transmitter/receiver, by physical retrieval of the storage device, or by physical retrieval of the dummy frac plug.

9 Claims, 3 Drawing Sheets

Related U.S. Application Data

(60) Provisional application No. 62/781,427, filed on Dec. 18, 2018.

(51) Int. Cl.

| | |
|---|---|
| ***E21B 47/06*** | (2012.01) |
| ***E21B 47/13*** | (2012.01) |
| *E21B 43/26* | (2006.01) |

(56) References Cited

U.S. PATENT DOCUMENTS

| | | | | |
|---|---|---|---|---|
| 2,230,712 | A | 2/1941 | William | |
| 2,364,419 | A | 12/1944 | Barnes | |
| 4,697,640 | A | 10/1987 | Szarka | |
| 4,735,264 | A | 4/1988 | Burris | |
| 4,867,237 | A * | 9/1989 | Wilson | E21B 47/06 166/250.07 |
| 4,901,794 | A | 2/1990 | Baugh | |
| 5,217,075 | A | 6/1993 | Wittrisch | |
| 5,353,873 | A | 10/1994 | Cooke, Jr. | |
| 5,390,737 | A | 2/1995 | Jacobi | |
| 5,819,846 | A | 10/1998 | Bolt, Jr. | |
| 6,443,458 | B1 | 9/2002 | Jansch | |
| 6,538,576 | B1 | 3/2003 | Schultz | |
| 6,766,854 | B2 | 7/2004 | Ciglenec | |
| 7,140,434 | B2 | 11/2006 | Chouzenoux | |
| 7,543,635 | B2 | 6/2009 | East | |
| 7,703,510 | B2 | 4/2010 | Xu | |
| 8,141,638 | B2 | 3/2012 | Tulissi et al. | |
| 8,211,248 | B2 | 7/2012 | Marya | |
| 8,231,947 | B2 | 7/2012 | Vaidya | |
| 8,469,109 | B2 | 6/2013 | Wang | |
| 8,567,494 | B2 | 10/2013 | Rytlewski | |
| 8,607,864 | B2 | 12/2013 | Mcleod et al. | |
| 8,839,855 | B1 | 9/2014 | McClinton | |
| 8,893,810 | B2 | 11/2014 | Zimmerman et al. | |
| 8,899,317 | B2 | 12/2014 | Frazier | |
| 9,033,041 | B2 | 5/2015 | Baihly | |
| 9,042,200 | B2 | 5/2015 | Segal | |
| 9,045,963 | B2 | 6/2015 | Shkurti | |
| 9,212,547 | B2 * | 12/2015 | Miller | E21B 33/134 |
| 9,611,709 | B2 | 4/2017 | O'Malley | |
| 9,896,920 | B2 | 2/2018 | Holder | |
| 9,982,505 | B2 | 5/2018 | Rytlewski | |
| 9,988,867 | B2 | 6/2018 | Jacob | |
| 9,988,870 | B2 | 6/2018 | Gray | |
| 10,077,626 | B2 * | 9/2018 | Xu | E21B 43/116 |
| 10,138,706 | B2 | 11/2018 | Baihly | |
| 10,233,720 | B2 | 3/2019 | Tse | |
| 10,240,448 | B2 * | 3/2019 | Kuehl | E21B 33/1294 |
| 10,301,910 | B2 | 5/2019 | Whitsitt | |
| 10,301,927 | B2 | 5/2019 | Sallwasser | |
| 10,316,616 | B2 | 6/2019 | Stafford | |
| 10,352,121 | B2 | 7/2019 | Wise | |
| 10,364,629 | B2 | 7/2019 | Jacob | |
| 10,443,354 | B2 * | 10/2019 | Murphree | E21B 23/01 |
| 10,450,829 | B2 | 10/2019 | Melenyzer | |
| 10,458,200 | B2 | 10/2019 | Tse | |
| 10,508,526 | B2 | 12/2019 | Ring | |
| 10,533,393 | B2 * | 1/2020 | Arsalan | E21B 33/146 |
| 10,533,402 | B2 * | 1/2020 | de Jong | E21B 47/09 |
| 10,538,988 | B2 | 1/2020 | Pabon | |
| 10,619,084 | B2 | 4/2020 | Okura | |
| 10,689,971 | B2 | 6/2020 | Smith | |
| 10,738,561 | B2 | 8/2020 | Kobayashi | |
| 10,801,315 | B2 | 10/2020 | Fripp | |
| 10,907,429 | B2 * | 2/2021 | Xu | E21B 33/134 |
| 10,914,163 | B2 * | 2/2021 | Bustos | E21B 47/138 |
| 2004/0026079 | A1 | 2/2004 | Johnson | |
| 2004/0241049 | A1 | 12/2004 | Carvalho | |
| 2005/0269083 | A1 * | 12/2005 | Burris | E21B 23/00 166/255.2 |
| 2009/0038790 | A1 | 2/2009 | Barlow | |
| 2010/0186970 | A1 | 7/2010 | Burnett | |
| 2010/0276159 | A1 | 11/2010 | Mailand | |
| 2011/0139466 | A1 | 6/2011 | Chen | |
| 2013/0133883 | A1 | 5/2013 | Hill, Jr. | |
| 2013/0140042 | A1 | 6/2013 | Benson | |
| 2014/0190685 | A1 | 7/2014 | Frazier | |
| 2014/0363692 | A1 | 12/2014 | Marya | |
| 2015/0107825 | A1 | 4/2015 | Miller et al. | |
| 2015/0122493 | A1 | 5/2015 | Wood | |
| 2015/0176386 | A1 | 6/2015 | Castillo | |
| 2015/0300121 | A1 | 10/2015 | Xu | |
| 2016/0097269 | A1 | 4/2016 | Kuehl | |
| 2016/0138362 | A1 | 5/2016 | Dockweiler | |
| 2016/0186511 | A1 | 6/2016 | Coronado | |
| 2016/0265304 | A1 | 9/2016 | Liu | |
| 2016/0290095 | A1 | 10/2016 | Cromer | |
| 2016/0299253 | A1 | 10/2016 | Zhang | |
| 2016/0348485 | A1 | 12/2016 | Castillo | |
| 2017/0130553 | A1 | 5/2017 | Harris | |
| 2017/0138150 | A1 | 5/2017 | Yencho | |
| 2017/0145781 | A1 | 5/2017 | Silva | |
| 2017/0335644 | A1 | 11/2017 | Ciezobka | |
| 2017/0335678 | A1 | 11/2017 | Ciezobka | |
| 2017/0362914 | A1 | 12/2017 | Wise | |
| 2018/0112486 | A1 | 4/2018 | Potts | |
| 2018/0112525 | A1 | 4/2018 | Kabannik et al. | |
| 2018/0252091 | A1 | 9/2018 | Bustos | |
| 2018/0306001 | A1 | 10/2018 | Themig | |
| 2018/0340391 | A1 | 11/2018 | Gray | |
| 2018/0371895 | A1 | 12/2018 | Taal | |
| 2019/0010780 | A1 | 1/2019 | Clemens | |
| 2020/0149381 | A1 | 5/2020 | Ring | |
| 2020/0316822 | A1 | 10/2020 | Bourquard | |
| 2020/0325748 | A1 | 10/2020 | Sanchez | |
| 2020/0347694 | A1 | 11/2020 | Power | |
| 2021/0317724 | A1 | 10/2021 | Romer | |
| 2021/0363854 | A1 | 11/2021 | Tu | |
| 2022/0056779 | A1 * | 2/2022 | Aviles | E21B 47/07 |

FOREIGN PATENT DOCUMENTS

| | | | |
|---|---|---|---|
| CN | 103835677 | A | 6/2014 |
| CN | 103857872 | A | 6/2014 |
| CN | 104514513 | A | 4/2015 |
| CN | 104989317 | A | 10/2015 |
| CN | 106460504 | A | 2/2017 |
| CN | 108180014 | A | 6/2018 |
| EP | 3607169 | A1 | 2/2020 |
| RU | 2316643 | C2 | 2/2008 |
| RU | 2469180 | C2 | 12/2012 |
| RU | 2633883 | C1 | 10/2017 |
| WO | 2012010898 | A2 | 1/2012 |
| WO | 2017151384 | A1 | 9/2017 |
| WO | 2018160070 | C1 | 9/2018 |
| WO | 2018184742 | A1 | 10/2018 |
| WO | 2019023413 | A1 | 1/2019 |
| WO | 2020131991 | A1 | 6/2020 |
| WO | 2022164621 | A1 | 8/2022 |

* cited by examiner

SMART PLUG INTEGRATED SENSOR SYSTEM

CROSS-REFERENCE TO RELATED APPLICATION

Any and all applications for which a foreign or domestic priority claim is identified in the Application Data Sheet as filed with the present application are hereby incorporated by reference under 37 CFR 1.57. This application is a divisional of U.S. patent application Ser. No. 17/415,406, filed Jun. 17, 2021, which is a National Stage of International Application No. PCT/US2019/067046, filed Dec. 18, 2019, which claims priority to U.S. Provisional Application Ser. No. 62/781,427, filed Dec. 18, 2018, which is incorporated herein by reference in its entirety.

BACKGROUND

Following discovery of a desired subterranean resource, e.g. oil, natural gas, or other desired subterranean resources, well drilling and fracturing operations are sometimes performed to facilitate retrieval of the subterranean resource. During a fracturing operation, a frac plug may be deployed downhole and set at a desired location along a wellbore. The frac plug allows pressure to be applied downhole and out through perforations into the surrounding formation, thus enabling fracturing of the formation. To obtain information on the fracturing operation, relatively expensive external gauges are deployed and corresponding control lines are run on the outside of casing. However, the external gauges and control lines can become damaged during installation and may involve expensive and inconsistently oriented perforating. Moreover, dummy frac plugs are sometimes run in "plug-and-perf" operations. However, dummy frac plug runs tend to be very limited with respect to what they can achieve.

SUMMARY

In general, the present disclosure provides a system and methodology for obtaining information, e.g. temperature and pressure data, related to a fracturing operation, a run-in-hole operation, or a pull-out-of hole operation. According to one or more embodiments of the present disclosure, a frac plug is provided with electronics for obtaining the desired information related to the operation. For example, the frac plug may be constructed with electronic sensors, a digital storage device, and a power supply and/or other power related equipment. Depending on the application, the frac plug may be a composite frac plug, degradable frac plug, dummy frac plug, or other suitable frac plug. In embodiments of the present disclosure where the frac plug is a dummy frac plug, the dummy frac plug may be coupled with electronics for obtaining information related to the run-in-hole or pull-out-of hole operations, for example. Retrieval of the information obtained may be done via coupling with an associated device, e.g. inductive or physical coupling, by utilizing a broadcast transmitter/receiver, by physical retrieval of the storage device, or by physical retrieval of the dummy frac plug in certain embodiments.

According to one or more embodiments of the present disclosure, a system for obtaining information during a downhole operation includes a disposable frac plug having sensors for obtaining data during a fracturing operation, and a data transfer system by which the data obtained via the sensors may be provided to a surface location.

According to one or more embodiments of the present disclosure, a method includes providing a frac plug with a sensor, positioning the frac plug in a borehole drilled into a formation, performing a fracturing operation with respect to the formation, and using the sensor to obtain data related to the fracturing operation.

According to one or more embodiments of the present disclosure, a system for obtaining information within a borehole lined with casing includes a plug and at least one sensor coupled to the plug for collecting data within the cased borehole, wherein the plug is not anchored in the casing when the at least one sensor collects the data.

According to one or more embodiments of the present disclosure, a method includes providing a plug with at least one sensor, running the plug into a borehole lined with casing without anchoring the plug to the casing, and collecting data with the at least one sensor.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for obtaining information (e.g. temperature data, pressure data, or other desired data) related to a fracturing operation. According to an embodiment, a frac plug is provided with electronics for obtaining the desired information related to the fracturing operation. For example, the frac plug may be constructed with electronic sensors, a digital storage device, and a power supply and/or other power related equipment. Depending on the application, the frac plug may be a composite frac plug, degradable frac plug, or other suitable frac plug. Retrieval of the information obtained may be done via coupling with an associated device, e.g. inductive or physical coupling, by utilizing a broadcast transmitter/receiver, or by physical retrieval of the storage device.

The technology allows operators to obtain downhole readings during and/or after a fracturing operation without using external gauges. As a result, the data may be obtained at lower cost and with less risk. According to an embodiment, a plug, e.g. a frac plug, incorporates battery-operated sensors, e.g. gauges. The sensors may be used to measure various parameters such as temperature and pressure. In some applications, recording of data by the frac plug may be initiated once the frac plug is attached to a wireline adapter kit. The data may be related to run-in-hole conditions, fracturing conditions, production information, and/or other desired parameters. Additionally, the collected data may be stored internally on the frac plug or at another suitable location. The data may be sent to the surface via wireline or wireless transmission. In some applications, the data may be stored on a retrievable memory device or transmitted along tubing during, for example, a mill out procedure or other subsequent procedure.

Figure 1:
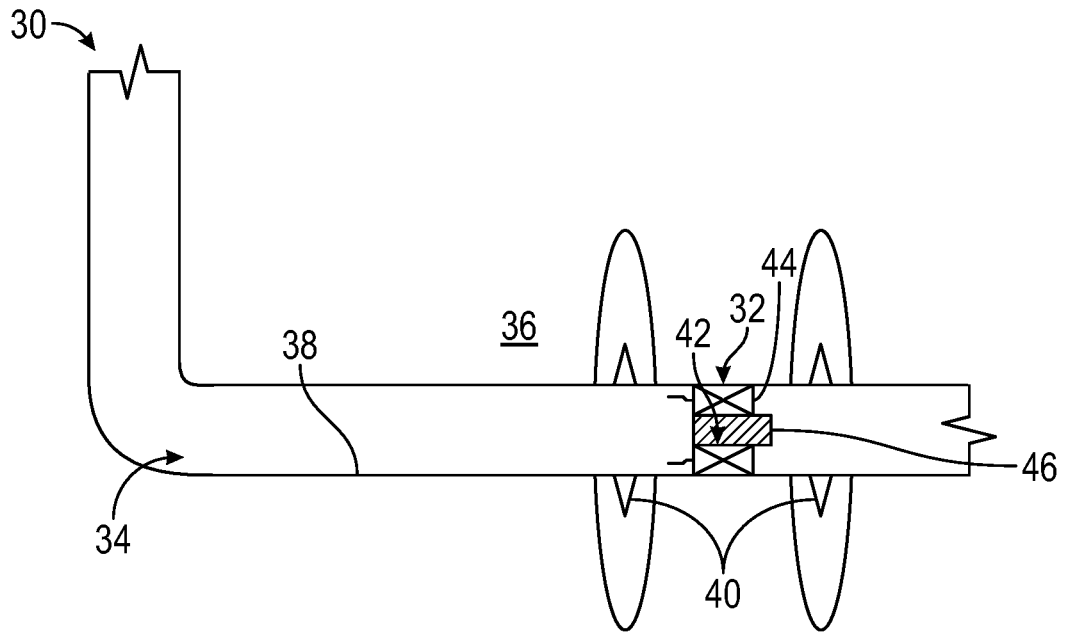
FIG. 1 is a schematic illustration of an example of a plug having sensors, the plug being deployed downhole in a borehole, according to one or more embodiments of the present disclosure.

Referring generally to FIG. 1, an embodiment of a well system 30 is illustrated as having a plug 32 deployed in a borehole 34 drilled through a surrounding formation 36 containing, for example, hydrocarbons. The borehole 34 may be lined by a casing 38 and perforated such that a plurality of perforations 40 extend into the surrounding formation 36.

In this specific example, the plug 32 is a frac plug with at least one sensor 42, e.g. a plurality of sensors 42. The frac plug 32 may be sealed with respect to the surrounding casing 38 via a seal element 44. In some embodiments, the sensors 42 are mounted in a removable cartridge 46. The sensors 42 may comprise at least one pressure sensor, at least one temperature sensor, and/or other sensors for obtaining data on desired parameters. In some embodiments, the sensors 42 are fitted to a top end of the plug 32 for sensing changing events at locations above/uphole of the plug 32. However, the sensors 42 also may be fitted to a bottom end of the plug 32 to sense changing events below the plug 32 (sensors 42 also may be fitted to both the top end and the bottom end of the plug 32).

Figure 2:
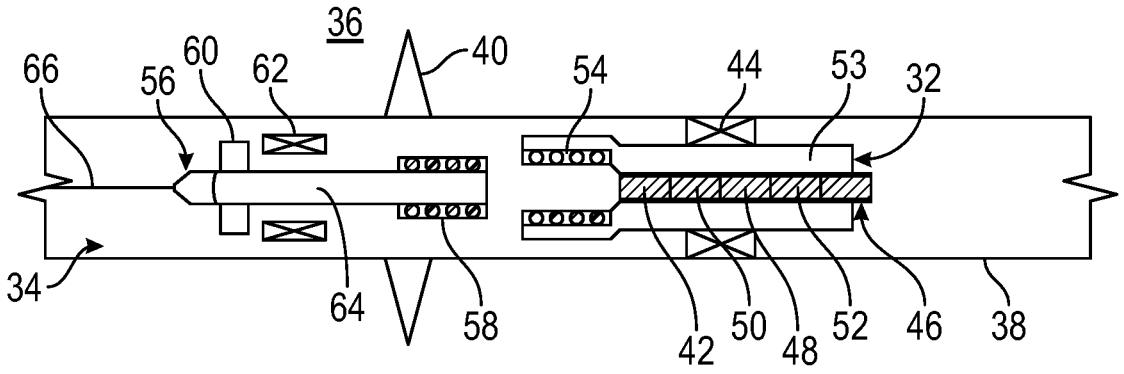
FIG. 2 is a schematic illustration of an example of a plug deployed in a borehole and oriented for cooperation with a data transfer device, according to one or more embodiments of the present disclosure.

As further illustrated in FIG. 2, plug 32 also may comprise a memory module 48, e.g. a data storage device, to store the acquired measurements. In this example, the plug 32 further comprises suitable electronics 50 coupled with the sensors 42, memory module/data storage device 48, and a power supply 52, e.g. battery. In some embodiments, the sensors 42, memory module 48, and power supply 52 may be positioned in a corresponding mandrel 53 of removable cartridge 46.

According to the example illustrated, the plug 32 is a frac plug which also includes an inductive coupler 54, e.g. a female inductive coupler, which enables communication with a tool string 56 above the plug 32 after it is set in the borehole 34, e.g. wellbore. In this example, the tool string 56 comprises a corresponding inductive coupler 58, e.g. a male inductive coupler. The inductive coupler 54, 58 may be part of an overall data transfer system. However, the data transfer and/or data transfer system may use a variety of techniques and may comprise a variety of components, e.g. memory module 46, as described in greater detail herein.

Depending on the type of application, the tool string 56 may comprise a variety of other features, such as a setting adapter 60 and an additional plug 62, e.g. an additional frac plug. Such features may be mounted on a tool body 64 coupled with, for example, a wireline 66 which extends to a surface location. Data may be transferred from the plug 32 through the inductive couplers 54, 58 and to the surface via the wireline 66.

Figure 3:
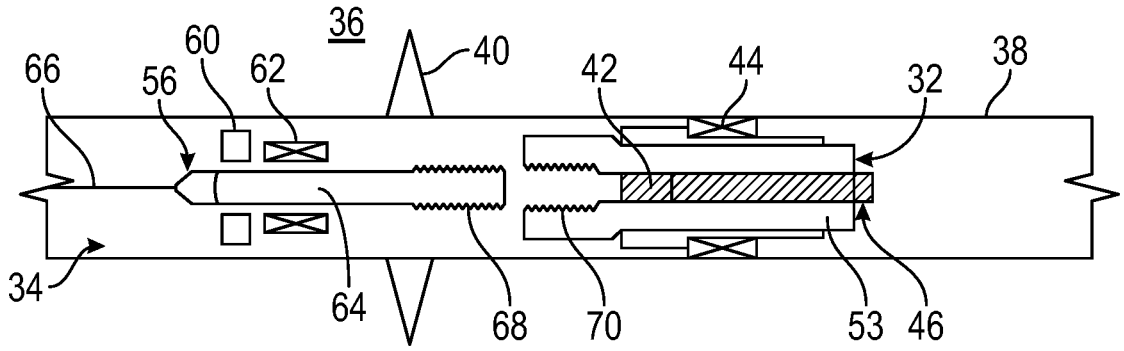
FIG. 3 is a schematic illustration of an example of a plug and a data module retrieval device deployed downhole in a borehole, according to one or more embodiments of the present disclosure.

However, the data obtained by sensors 42 may be provided to the desired surface location via other techniques. For example, the tool body 64 may be combined with a latch 68, e.g. a male latch, oriented for engagement with a corresponding latch 70, e.g. female latch, on removable cartridge 46 as illustrated in FIG. 3. In this type of example, the data collected by sensors 42 may simply be stored in the memory module 48 of removable cartridge 46.

Figure 4:
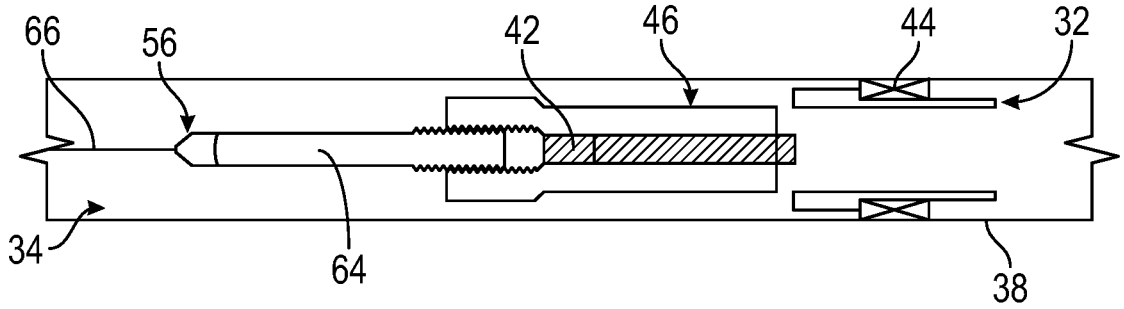
FIG. 4 is a schematic illustration showing a data module being retrieved from the plug, according to one or more embodiments of the present disclosure.

To retrieved data, the tool string 56 is deployed downhole until latch 68 engages corresponding latch 70. At this stage, the tool string 56 may be retrieved which effectively pulls the removable cartridge 46 from the plug 32, as illustrated in FIG. 4. The memory module 48 may then be retrieved to the surface. The data may subsequently be collected from the memory module/data storage device 48.

Figure 5:
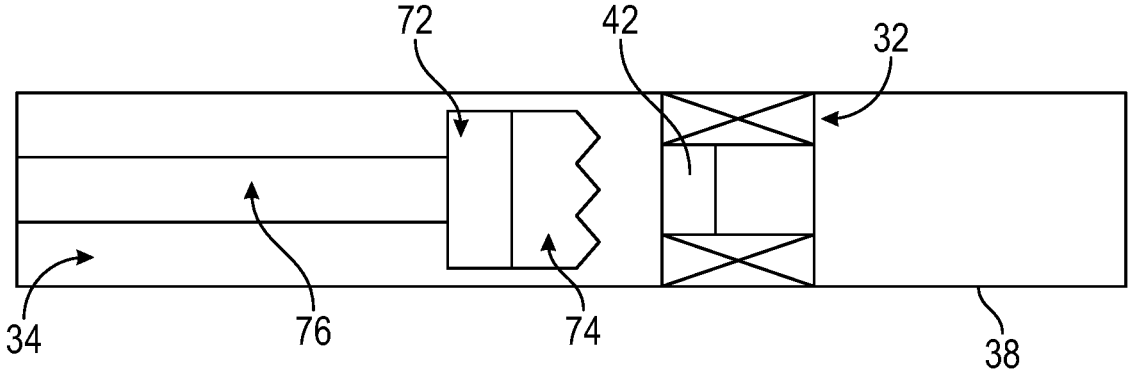
FIG. 5 is a schematic illustration of a plug with sensors from which data may be retrieved via a data gathering unit mounted on a milling tool, according to one or more embodiments of the present disclosure.

In some embodiments, data obtained via sensors 42 may be retrieved from plug 32 during a subsequent operation, e.g. a milling operation, as illustrated in FIG. 5. In this embodiment, a data gathering unit 72 is combined with a mill tool 74 and deployed via, for example, tubing 76, e.g. coiled tubing or other suitable tubing. The data stored at frac plug 32 may be retrieved via data gathering unit 72 and provided to a surface location when the mill tool 74 is retrieved. In some applications, the data may be transmitted to the surface along the tubing 76.

In other applications, the data obtained from sensors 42 may be transferred wirelessly to a separate memory module that is physically recovered during a production operation or intervention. The data from sensors 42 also may be transferred wirelessly to a temporary memory or to a receiver. In some applications, the data from sensors 42 can be transmitted via tracer materials released from the plug 32.

According to an operational example, the smart plug 32 is set in wellbore 34 using a normal conveyance string and setting mechanism. A fracture stimulation is then conducted in a zone above the frac plug 32. Subsequently, tool string 56 is run into wellbore 34 and engaged with the plug 32. The data stored in the smart plug 32 is downloaded to the appropriate device on tool string 56. In some embodiments, the data may be transferred to the tool string 56 via the inductive couplers 54, 58 or by mechanical retrieval of the memory module 48. In some embodiments, the tool string 56 may carry the additional frac plug 62 or other tools to facilitate treating of subsequent well zones. In some operations, the entire well can be completed with smart plugs 32 and the data may be gathered during post fracturing intervention procedures.

Figure 6:
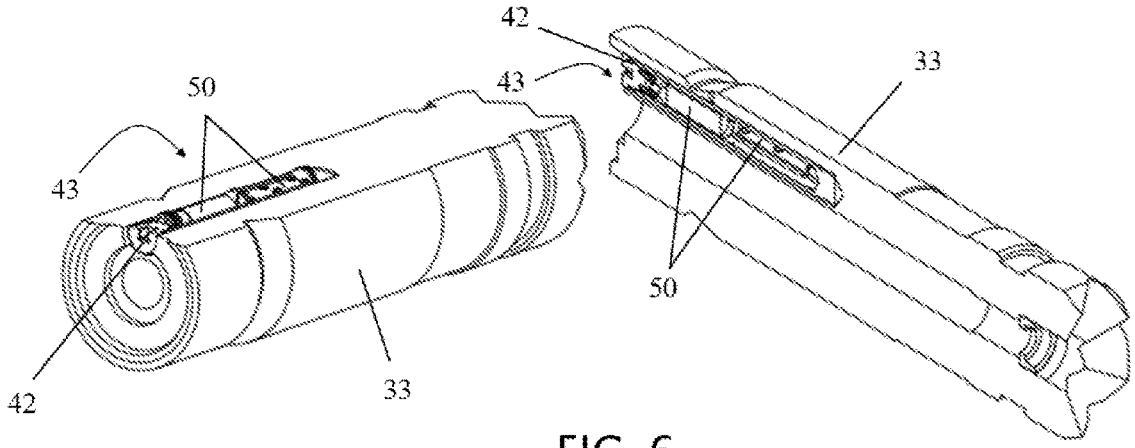
FIG. 6 is a perspective view of a dummy plug with at least one sensor, according to one or more embodiments of the present disclosure.

Referring now to FIG. 6, a perspective view of a dummy plug 33 with at least one sensor 42, according to one or more embodiments of the present disclosure, is shown. Specifically, FIG. 6 shows the dummy plug 33 in two parts so that the sensor 42 coupled to the dummy plug 33 may be more easily seen. As shown in FIG. 6, the sensor 42 may be embedded within the dummy plug 33, according to one or more embodiments of the present disclosure. In other embodiments, the sensor 42 or any type of electronic board may be integrated into or run alongside the dummy plug 33. In one or more embodiments of the present disclosure, the sensor 42 may be any type of downhole sensor capable of measuring shock, vibration, azimuth, temperature data, or any other downhole condition, for example. As further shown in FIG. 6, the sensor 42 may be a component of a sensor package 43, coupling the sensor 42 with suitable electronics 50, which may include a memory module/data storage device and a power supply, e.g. battery, according to one or more embodiments of the present disclosure.

Still referring to FIG. 6, the dummy plug 33 may have a profile and dimensions that mimic those of other frac plugs, including the smart frac plugs described herein according to one or more embodiments of the present disclosure. Moreover, in the dummy plug 33 according to one or more embodiments of the present disclosure, buttons for biting into the surrounding casing are unnecessary at least because the dummy plug 33 does not anchor in the casing. Moreover, the dummy plug 33 may or may not isolate the casing. Indeed, in one or more embodiments of the present disclosure, the dummy plug 33 is not sealed with respect to the casing. In this way, the dummy plug 33 according to one or more embodiments of the present disclosure is essentially a gage bar that may be used to test for restrictions during run-in-hole operations, or to assist in pumping down of a wireline bottom hole assembly (BHA), for example. Moreover, the at least one sensor 42 coupled to the dummy plug 33 may collect data (e.g., shock, vibration, azimuth, temperature data, or any other downhole conditions) within the cased borehole while the dummy plug 33 is neither anchored in the casing nor sealed with respect to the casing in one or more embodiments of the present disclosure. As such, in one or more embodiments of the present disclosure, the at least one sensor 42 coupled to the dummy plug 33 may collect data during a run-in-hole operation or a pull-out-of-hole operation, for example.

Advantageously, the dummy plug 33 may be recovered at the surface after the at least one sensor 42 collects data downhole. In one or more embodiments of the present disclosure, the dummy plug 33 may be pulled back out of hole sometime after reaching a desired depth downhole. Thus, the feat of recovering the data collected by the at least one sensor 42 of the dummy plug 33 may be greatly simplified.

In a method according to one or more embodiments of the present disclosure, at least one sensor 42 coupled to a dummy plug 33 is awakened before running the dummy plug 33 downhole into a borehole, which may be lined with casing. During the downhole run, the dummy plug 33 is neither anchored to or sealed with respect to the casing. While downhole, the at least one sensor 42 of the dummy plug 33 collects data related to downhole conditions, as previously described. In one or more embodiments of the present disclosure, the at least one sensor 42 may collect continuously collect data downhole after being awakened, or may collect data at a particular depth interval downhole. Thereafter, the dummy plug 33 may be pulled out of the borehole and returned to the surface, where the downhole data may be extracted from the sensor 42 (or an on-board memory module in cooperation with the sensor 42), and recorded. Such data extraction and recordation may be accomplished using methods within the knowledge of those skilled in the art. In one or more embodiments of the present disclosure, the dummy plug 33 may be returned to surface via a wireline or coiled tubing BHA. Advantageously, the method according to one or more embodiments of the present disclosure is non-disruptive to a run-in-hole, pull-out-of hole, or other downhole operation that is already occurring. In this way, the collected data may be recorded and recovered at the surface passively in accordance with one or more embodiments of the present disclosure.

Figure 7:
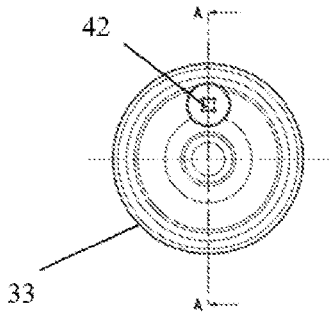
FIG. 7 is a top view of a dummy plug with at least one sensor, according to one or more embodiments of the present disclosure.
Figure 8:
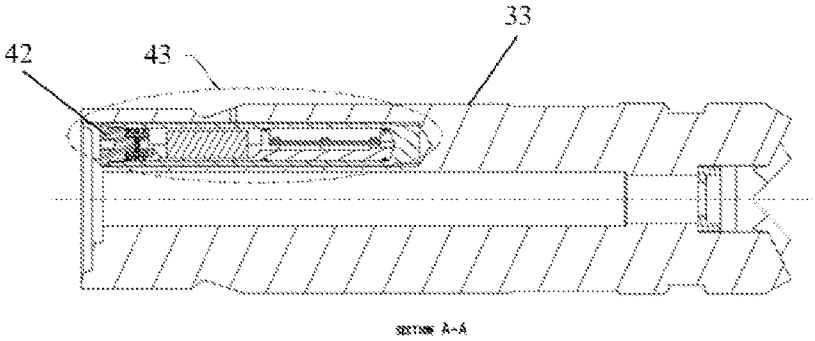
FIG. 8 is cross-sectional view of the dummy plug of FIG. 7 along line A-A, according to one or more embodiments of the present disclosure.

Referring now to FIG. 7, a top view of a dummy plug 33 with a sensor 42, according to one or more embodiments of the present disclosure is shown. As shown, FIG. 7 shows a line A-A that bisects the sensor 42 and the dummy plug 33. Further, FIG. 8 shows a cross-sectional view of the dummy plug 33 of FIG. 7 along the line A-A, according to one or more embodiments of the present disclosure. Although FIGS. 7 and 8 show one sensor 42 coupled to the dummy plug 33, the dummy plug 33 may include additional sensors in accordance with one or more embodiments of the present disclosure. For example, the dummy plug 33 may include two sensor packages, including one sensor package above the dummy plug 33 and another sensor package below the dummy plug 33.

In a method according to one or more embodiments of the present disclosure, an operator may opt not to recover the dummy plug 33 at the surface after data collection by the at least one sensor 42. Instead, an emergency release feature of the dummy plug 33 may allow the operator to abandon the dummy plug 33 at depth in the wellbore. In such embodiments, additional telemetry may be implemented to wirelessly recover the collected data.

In one or more embodiments of the present disclosure, the at least one sensor 42 may be mechanically recovered from the dummy plug 33 via wet mate, collet, spear, or magnet, for example. In other embodiments of the present disclosure, the sensor package may also include a buoyancy feature to facilitate recovery at the surface without the dummy plug 33.

In other embodiments of the present disclosure, the sensor 42, while still coupled to the dummy plug 33 in some way, may be located somewhere else on the wireline BHA, such as on a tension mandrel or other adapter kit component, a collar, a standalone subassembly, a perforation gun, etc. Locating the sensor 42 on a component such as these may improve chances of recovering the sensor 42 at surface after data collection.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for obtaining information during a downhole operation, comprising:

a disposable frac plug having sensors for obtaining data during a fracturing operation, the disposable frac plug further comprises a removable cartridge with a memory module, and the data from the sensors is stored in the memory module, the removable cartridge further comprises a removable cartridge latch; and a data transfer system by which the data obtained via the sensors is capable of being provided to a surface location with a wireline deployed downhole separately from the disposable frac plug, wherein the wireline comprises a wireline latch, and the wireline latch is configured to engage the removable cartridge latch for retrieval of the removable cartridge at the surface location.

2. The system as recited in claim 1, wherein the sensors comprise a temperature sensor.

3. The system as recited in claim 1, wherein the sensors comprise a pressure sensor.

4. The system as recited in claim 1, wherein the disposable frac plug comprises a power source for powering the sensors.

5. The system of claim 1, wherein the sensors are configured to obtain the data during a run-in-hole operation.

6. The system of claim 1, wherein the sensors are configured to obtain the data during a pull-out-of-hole operation.

7. A method, comprising:

providing a plug with at least one sensor, wherein the plug further comprises a removable cartridge with a memory module, and data from the at least one sensor is stored in the memory module, the removable cartridge further comprising a removable cartridge latch;

running the plug into a borehole and collecting data with the at least one sensor, wherein collecting data with the at least one sensor comprises deploying a wireline with a wireline latch;

engaging the removable cartridge latch with the wireline latch; and retrieving the removable cartridge at the surface.

8. The method of claim 7, wherein the collecting data step occurs during the running step.

9. The method of claim 7, wherein the collecting data step occurs during the retrieving step.

* * * * *